US010041751B2

(12) United States Patent
Sylvester et al.

(10) Patent No.: US 10,041,751 B2
(45) **Date of Patent: *Aug. 7, 2018**

(54) ROTARY LOCKUP ACTION

(71) Applicant: Primary Weapons, Boise, ID (US)

(72) Inventors: Dean Sylvester, Boise, ID (US); Derek Parker, Boise, ID (US)

(73) Assignee: Primary Weapons, Boise, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/677,955

(22) Filed: Aug. 15, 2017

(65) Prior Publication Data

US 2018/0010869 A1 Jan. 11, 2018

Related U.S. Application Data

(63) Continuation of application No. 15/204,657, filed on Jul. 7, 2016, now Pat. No. 9,733,031.

(51) Int. Cl.

| | |
|---|---|
| ***F41A 3/72*** | (2006.01) |
| ***F41A 3/26*** | (2006.01) |
| ***F41A 19/10*** | (2006.01) |
| ***F41A 3/66*** | (2006.01) |

(52) U.S. Cl.

CPC *F41A 3/72* (2013.01); *F41A 3/26* (2013.01); *F41A 3/66* (2013.01); *F41A 19/10* (2013.01)

(58) Field of Classification Search

CPC ..... F41A 3/72
USPC ..... 42/43, 16, 69.02, 69.03; 89/1.4, 1.42
See application file for complete search history.

(56) References Cited

U.S. PATENT DOCUMENTS

| | | | | |
|---|---|---|---|---|
| 3,257,749 | A | 6/1966 | Donaldson | |
| 3,979,849 | A | 9/1976 | Haskins | |
| 4,244,273 | A | 1/1981 | Langendorfer et al. | |
| 4,295,410 | A | 10/1981 | Patenaude et al. | |
| 4,920,855 | A | 5/1990 | Waters | |
| 5,148,619 | A | 9/1992 | Badali | |
| 8,590,197 | B1 | 11/2013 | Sylvester | |
| 8,745,909 | B1 | 6/2014 | Sylvester | |
| 9,377,258 | B2 | 6/2016 | Gomez | |
| 9,605,924 | B1 | 3/2017 | McCaslin | |
| 9,733,031 | B1 * | 8/2017 | Sylvester | F41A 3/72 |
| 2011/0061523 | A1 | 3/2011 | Webb | |
| 2014/0224103 | A1 | 8/2014 | Brown | |
| 2015/0053072 | A1 | 2/2015 | Bunker | |

* cited by examiner

*Primary Examiner* — J. Woodrow Eldred
(74) *Attorney, Agent, or Firm* — Schacht Law Office, Inc.; Dwayne Rogge

(57) ABSTRACT

Disclosed herein is a rotary lockup action including a firing mechanism for a firearm. The firearm including a receiver having a cavity therein configured to accept the firing mechanism. The firing mechanism comprising a bolt guide rail fixed to the inner surface of the cavity of the receiver. The firing mechanism also comprises a bolt sliding along a longitudinal axis on the bolt guide rail. Also disclosed is a change handle rotatably mounted to the bolt so as to rotate relative thereto about a vertical axis orthogonal to the longitudinal axis. The charge handle may be mounted to the bolt so as to longitudinally reposition therewith. The charge handle having a surface defining a cut therein aligned with a slot in the bolt when the bolt is in a rearward position; and wherein the surface defining a cut in the charge handle is not aligned with the slot in the bolt when the bolt is in a forward position.

6 Claims, 6 Drawing Sheets

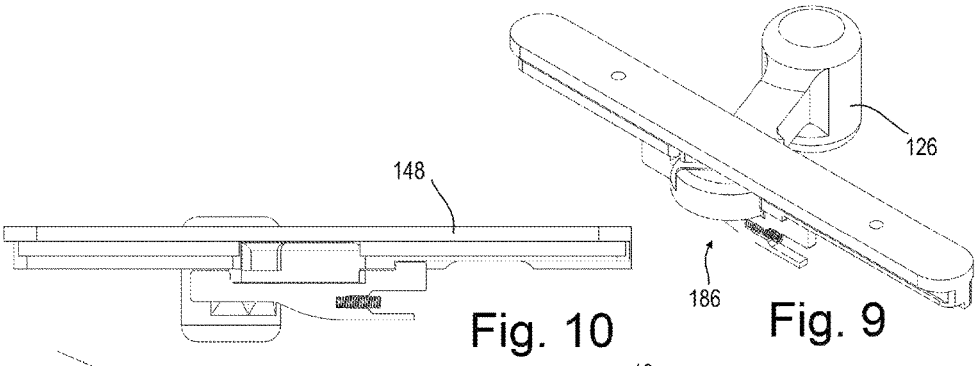
Fig. 10
Fig. 9
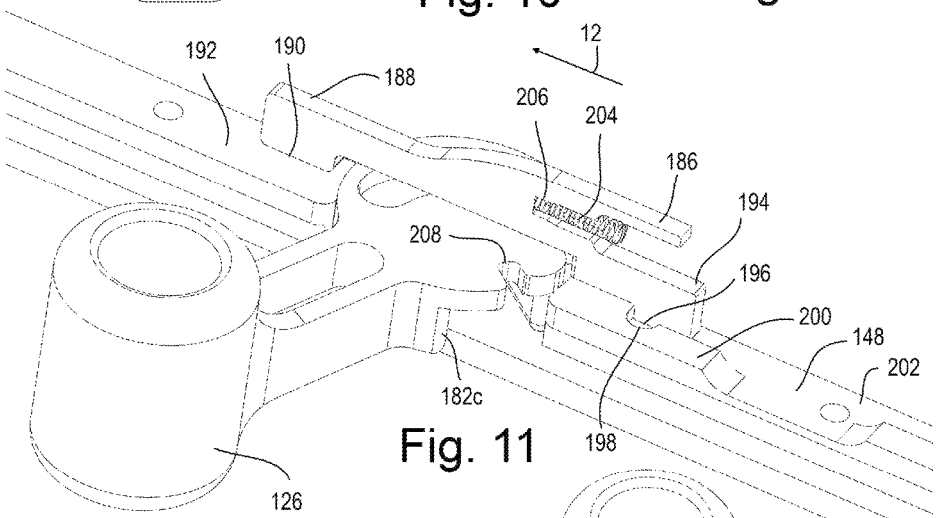
Fig. 11
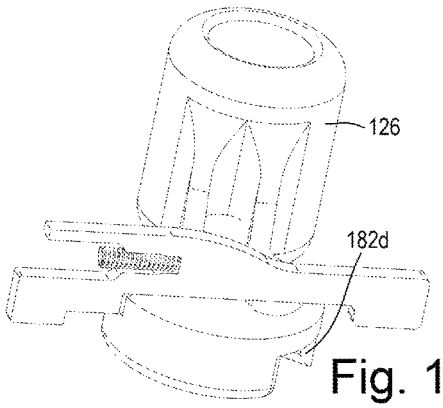
Fig. 12
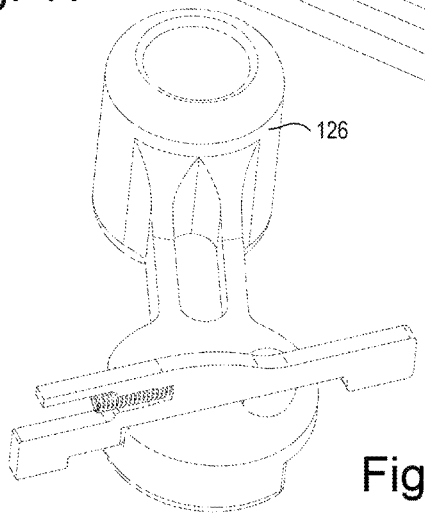
Fig. 13

ROTARY LOCKUP ACTION

RELATED APPLICATIONS

This application claims priority benefit of U.S. Ser. No. 15/204,657, filed Jul. 7, 2016, incorporated herein by reference.

BACKGROUND OF THE DISCLOSURE

Field of the Disclosure

This disclosure relates to the field of modifications to the firing mechanism of a firearm.

BRIEF SUMMARY OF THE DISCLOSURE

Disclosed herein is an example including a firing mechanism for a firearm. The firing mechanism comprising a receiver configured to be attached to a barrel, trigger, trigger housing, and having a cavity therein configured to accept a bolt. The firing mechanism comprising a bolt guide rail fixed to the inner surface of the cavity of the receiver. The firing mechanism also comprises a bolt sliding along a longitudinal axis on the bolt guide rail. Also disclosed is a change handle rotatably mounted to the bolt so as to rotate relative thereto about a vertical axis orthogonal to the longitudinal axis. The charge handle may be mounted to the bolt so as to longitudinally reposition therewith. The charge handle having a surface defining a cut therein, aligned with a slot in the bolt when the bolt is in a rearward position; and wherein the surface defining a cut in the charge handle is not aligned with the slot in the bolt when the bolt is in a forward position.

The firing mechanism may further comprise a timing lock arm engaging a surface defining a slot in the charge handle so as to prohibit rotation of the charge handle when the bolt is not in a most forward position (in battery).

The firing mechanism may further comprise a surface defining a T-slot in the bolt. The T-slot engaging a T-shaped protrusion mounted to the receiver so as to prohibit vertical and transverse movement of the bolt relative to the receiver.

The firing mechanism as recited may be arranged wherein the T-shaped protrusion is an I-beam rail removably attached to the receiver.

The firing mechanism may further comprise a firing pin movably attached to the charge handle so as to withdraw longitudinally within the receiver when the bolt is not in a most forward position.

The firing mechanism may be arranged wherein: the charge handle has a convex cylindrical surface with a vertical axis; and the bolt has concave cylindrical surface engaging the convex cylindrical surface of the charge handle allowing rotational movement of the charge handle relative to the bolt.

BRIEF DESCRIPTION OF THE SEVERAL VIEWS OF THE DRAWINGS

FIG. 9 is an enlarged isometric view of several components shown in FIG. 1 shown from a different angle.

FIG. 10 is another enlarged side view of the components shown in FIG. 9.

FIG. 11 is another enlarged isometric view of the components shown in FIG. 9 shown from a different angle.

FIG. 12 is another enlarged isometric view of several components shown in FIG. 9 shown from a different angle.

FIG. 13 is another enlarged isometric view of several components shown in FIG. 9 shown from a different angle.

DETAILED DESCRIPTION OF THE DISCLOSURE

This disclosure relates to the field of new designs, modifications to firearm actions (firing/reloading mechanisms) and associated components. In particular, this disclosure relates to the field of actions and associated components for a firearm. This disclosure relates to actions and associated components for firearms including those firearms known as a Ruger 10/22.

Figure 1:
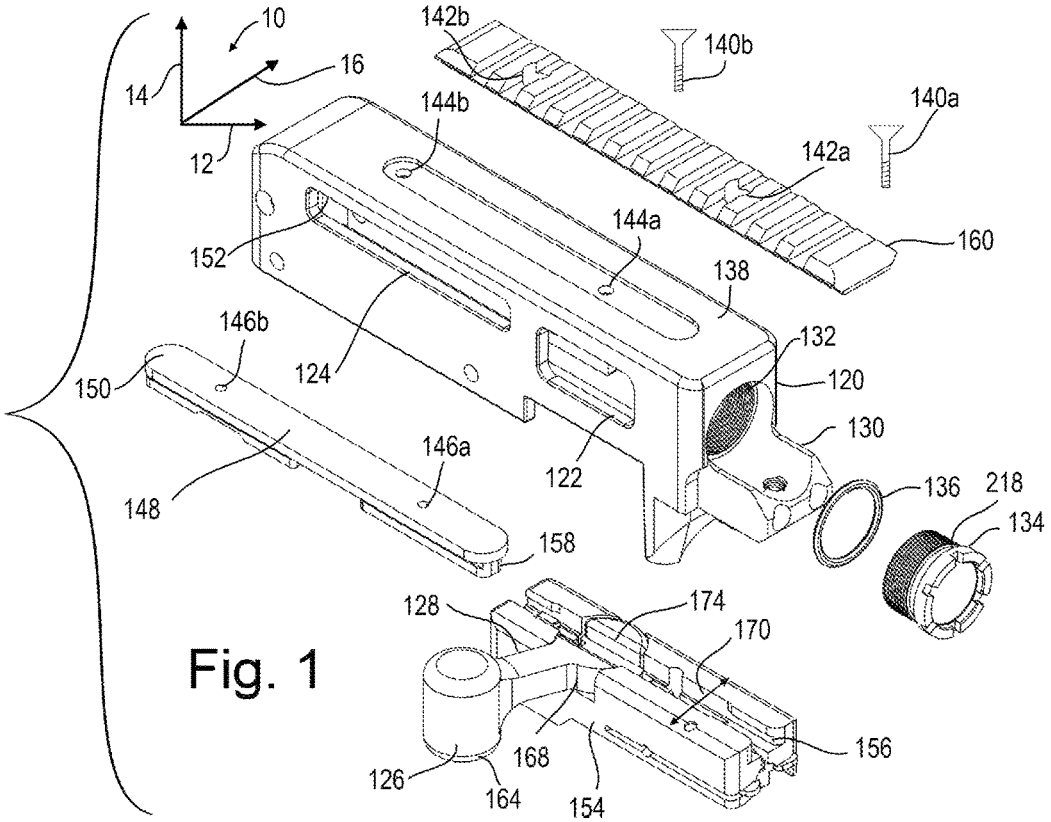
FIG. 1 is an exploded top isometric view of one example of the disclosed rotary lockup action (firing mechanism) components of a firearm.
Figure 2:
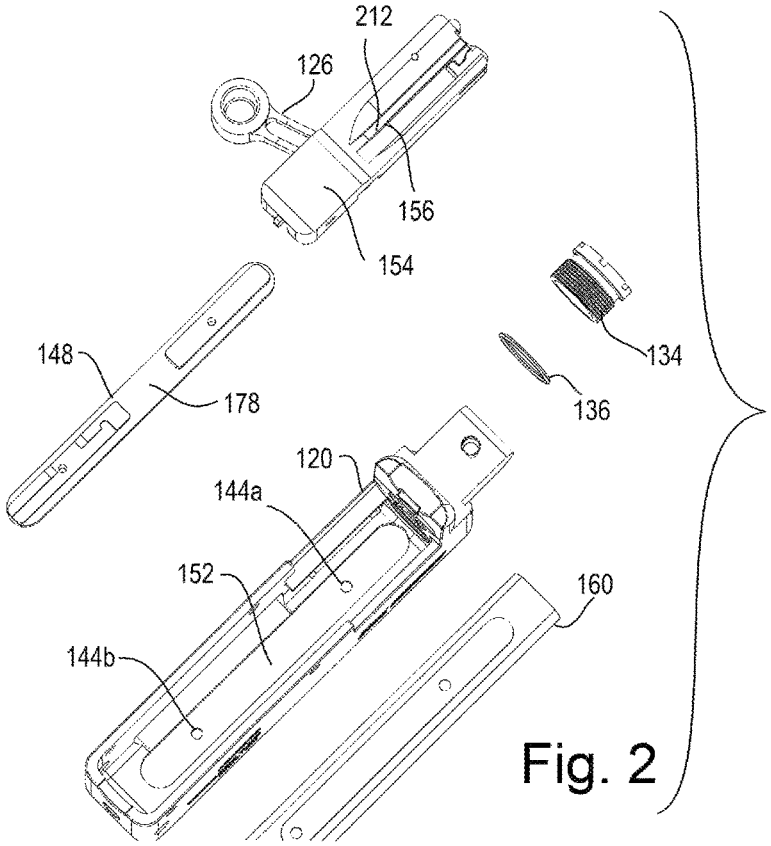
FIG. 2 is a bottom isometric view of the example shown in FIG. 1.

Before continuing, an axes system 10 is disclosed in FIG. 1 comprising a longitudinal axis 12, a vertical axis 14, and a transverse axis 16. These axes are to be used to assist in explanation, and are not intended to limit the disclosure to any particular orientation.

The disclosure relates to actions and associated components for firearms including those firearms known as a Ruger 10/22. The term "10-22" or "10/22" for this disclosure is defined as the rifle manufactured by Ruger® at the time of invention. Similarly, the term "10-22 action" for this disclosure is defined as the action manufactured by Ruger® for the 10-22 rifle at the time of invention.

Figure 20:
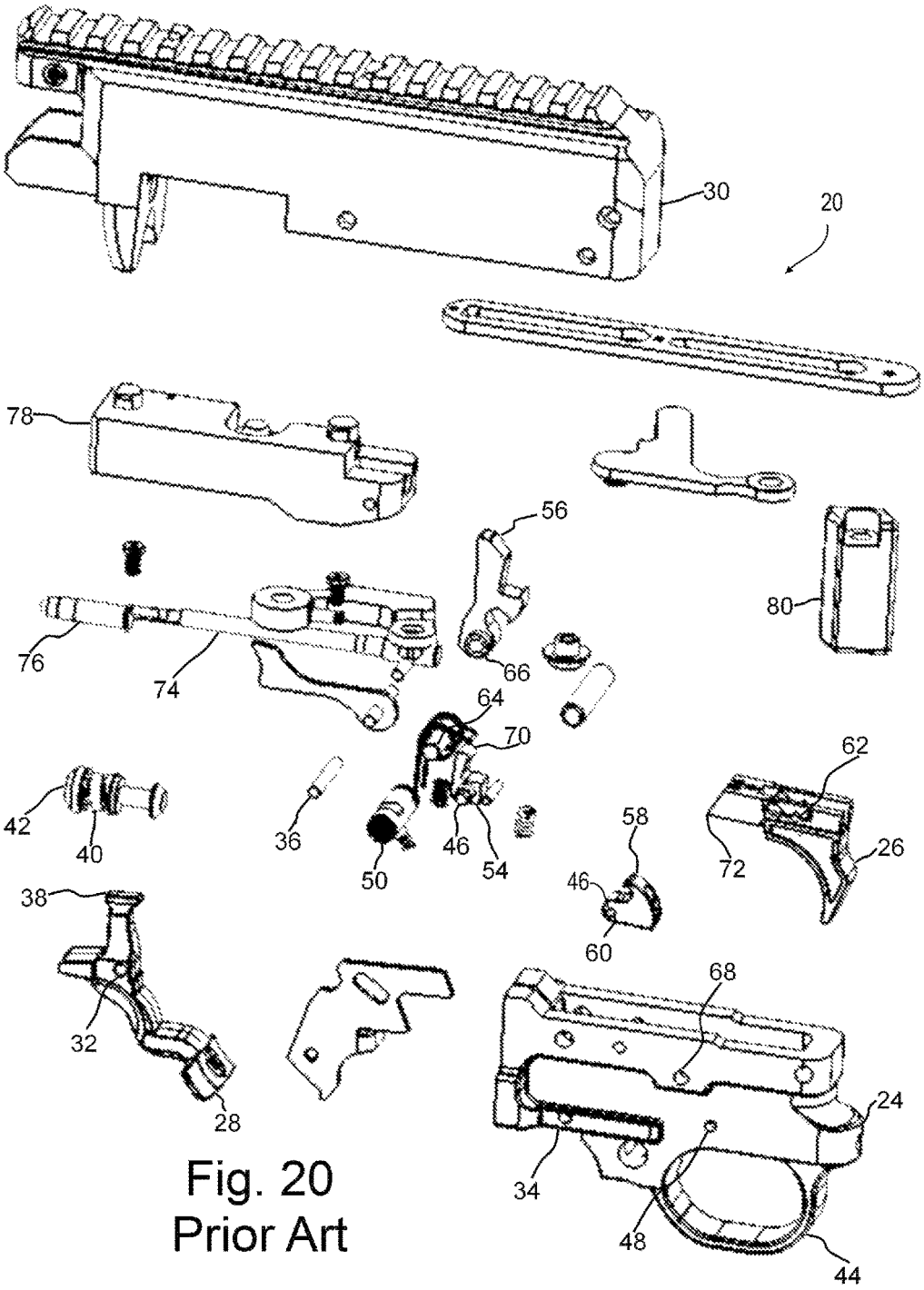
Fig. 20 Prior Art
FIG. 20 is an exploded view of the components of a prior art firearm action.

Looking to FIG. 20, components of a prior art firearm conversion unit 20 as disclosed in U.S. Pat. No. 8,590,197 (incorporated herein by reference) are shown for use in a stock trigger housing and barrel. Other portions of a firearm may not be adapted such as the barrel 22 shown in FIG. 14.

The unit 20 shown in FIG. 20 utilizes a receiver 30, main body, trigger housing 24 with a trigger 26, and magazine (mag) release 28.

The mag release 28 fits partially within the trigger housing 24 and pivots about pivot location 32 so as to selectively release spent cartridge magazines so as to allow insertion of a magazine with loaded cartridges. The pivot location 32 of the mag release aligns with pivot location 34 on the trigger housing and pivot pin 36 passes there through to allow the mag release 28 to pivot when pressed. The upper edge 38 of the mag release engages the magazine catch 40, which has a forward surface 42 that engages the magazine and holds the magazine within the magazine well of the receiver 30. A spring is shown which repositions the magazine catch 40 towards the magazine unless repositioned by pivoting of the mag release 28.

The trigger 26 fits within the trigger housing 24. The outwardly projecting portion of the trigger 26 is protected by the trigger guard 44 when connected to the unit 20. The trigger 26 pivots about pivot 46, which in one example is be a pin that passes through the surface defining the void 48 in the trigger housing 24. When the safety 50 is released, the trigger 26 is allowed to rotate or pivot when it is desired to fire the firearm. The trigger 26 is also coupled through the pivot 46 to a first seer 54, which engages the hammer 56. A second seer 58 is also coupled to the trigger 26 through a pivot 60, connected via another pin that passes through voids 62. The second seer 58 also engages the hammer 56. When the unit 20 is fired, the hammer 56 rotates about the pin 64, which passes through void 66 in the hammer 56 and void 68 in the trigger housing 24. A spring 70 engages the forward portion 72 of the trigger 26, as well as the hammer 56, to reposition the hammer 56 upward/forward when released by the seers 54 and 58 to engage the rear portion of a firing pin 74, repositioning it forward to engage the primer portion of a rifle cartridge 76. In one example, the cartridge is a rim fire, .22 caliber long rifle cartridge.

In many firearms, firing of the cartridge 76 would release the sliding bolt 78, repositioning the firing pin 74, and hammer 56 rearward/downward, whereupon the following (loaded) cartridge would be repositioned from the magazine into the firing location, whereupon activation of the trigger 26 again would fire this new (loaded) cartridge.

Utilizing a relatively heavy sliding bolt 78 maintains the sliding bolt 78 in a forward position following firing, to increase the muzzle velocity of the ejected bullet, which also increases accuracy of the firearm.

This assembly as shown in FIG. 20 allows for the user to eject and reload a cartridge without substantial movement of their body, as a simple finger movement can function to reposition the toggle handle 80 rearward and outward and again forward and inward to eject and insert shells. This movement may also reset the seer(s), trigger assembly and/or firing pin.

Looking to FIG. 1 is shown our new rotary lockup action (firing mechanism) for a firearm. This new action may be a modification to an existing firearm, or a new construction. FIGS. 2-19 show several components which are similar to or cooperate with components of the firearm disclosed above relative to FIG. 20. Several of the components of FIG. 20 that cooperate with the components of the new rotary lockup action are not duplicated in FIGS. 1-19 to more clearly show the novel components.

Figure 14:
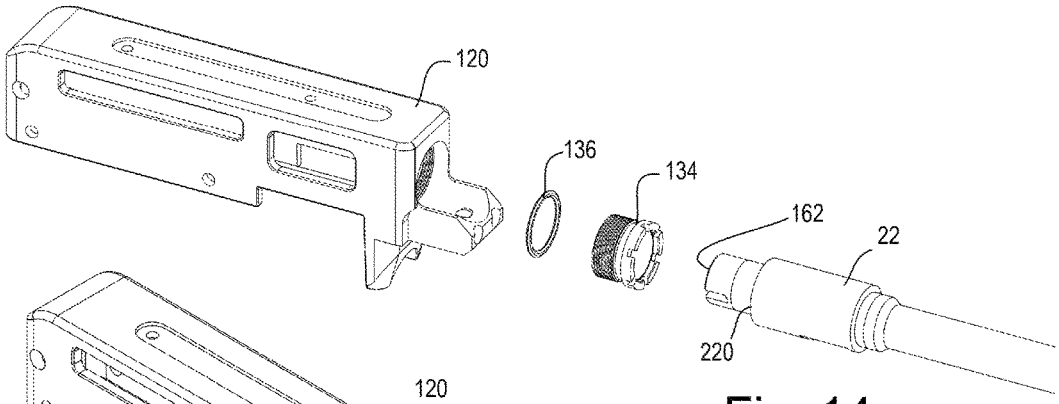
FIG. 14 is an enlarged isometric view of several components shown in FIG. 1 with a firearm barrel.
Figure 15:
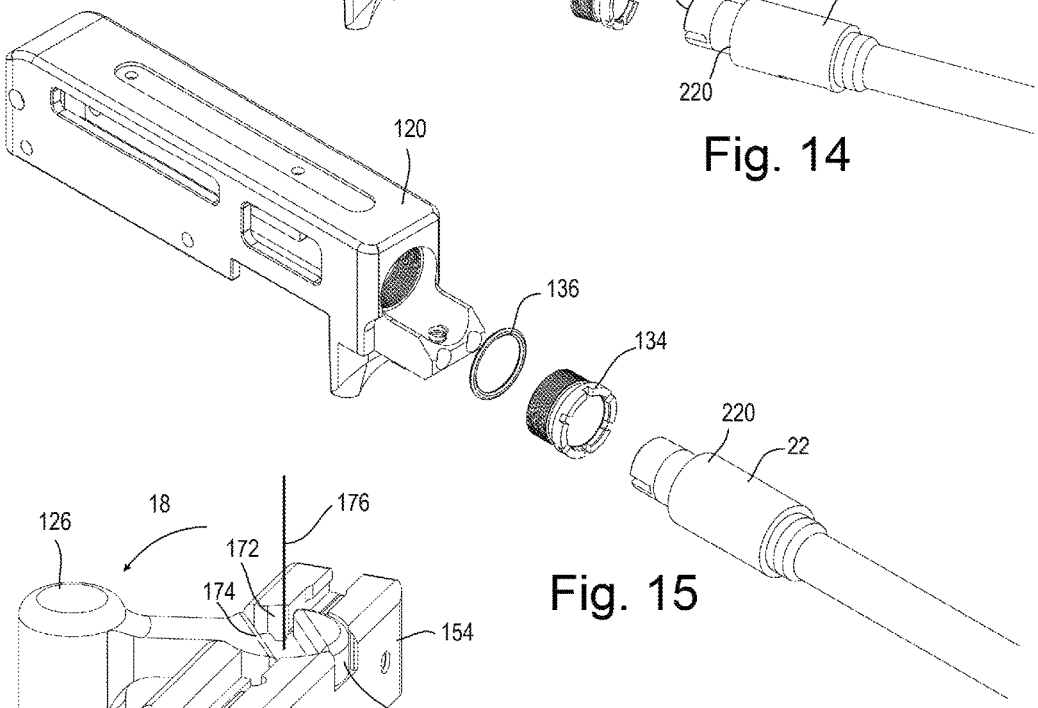
FIG. 15 is an enlarged isometric view of several components shown in FIG. 14 from a different angle.

In particular, it is shown that the receiver 120 of this embodiment comprises an ejection port 122 in the transverse side of the receiver as well as a charge handle opening 124 through which the charge handle 126 extends. During operation a shaft 128 of the charge handle 126 slides along the surface defining the charge handle opening 124. Although the viewing angle in FIG. 1 is reversed from the viewing angle of FIG. 20, it can be seen that the forward end 130 of the receiver 120 in this example comprises a threaded opening 132 into which is attached a male threaded headspace bushing 134. In the example shown, a spacer 136 may be interposed therebetween. The barrel 22 of the firearm attaches to the receiver 120 in this example via the headspace bushing 134 as shown in FIGS. 14-15 allowing for rotational and longitudinal adjustment of the barrel 22 relative to the receiver 120.

In some examples, accessories are desired to be removably mounted to the firearm and thus an accessory attachment 160 which in this example is a Picatinny rail may be mounted to the upper surface 138 of the receiver 120 via fasteners 140 passing through the voids 142 in the accessory rail 136 and also through the voids 144 through the upper surface 138 of the receiver 120. These fasteners 142 may be threaded into threaded receiver voids 146 of an I-beam bolt guide rail 148 which will be discussed in more detail. The upper surface 150 of the I-beam bold guide rail contacts the upper inner surface 152 of the receiver 120 during assembly.

Also shown is a unique sliding bolt 154, comprising a T-slot 156 which engages an inverted T-shaped protrusion 158 in the I-beam bolt guide rail 148 and slides there along. These two structures function to allow longitudinal 12 movement of the sliding bolt 154 relative to the receiver 120 but to prohibit vertical 14 or transverse movement between these components.

Looking to FIG. 1 it can be seen that the charge handle 126 is shown rotated to a position relative to the bolt 154 to a position that allows the bolt 154 and attached charge handle 126 to slide longitudinally 12 along the I-beam bolt guide rail 148 so as to allow for ejection of a spent (fired) cartridge and loading of an unfired cartridge into the chamber 162 (FIG. 14) of the firearm.

Looking to FIG. 1 it can be seen that the charge handle 126 has a first transverse end 164 which may be engaged by a user and a second transverse end 166 having a substantially cylindrical outer surface 168 of radius equal or less than the transverse width 170 of the bolt 154 so as to not interfere with longitudinal sliding thereof within the inner surfaces of the receiver 120. The surface 168 engages a female cylindrical surface 172 of the bolt 154 so as to freely rotate therein with restrictions as will be described. In FIG. 1 there is also shown a surface defining an uninterrupted cut 174 through the cylindrical portion of the charge handle 126 which allows passage of the bolt 154 along the I-beam bolt guide rail 148 with exclusions as disclosed below.

Figure 16:
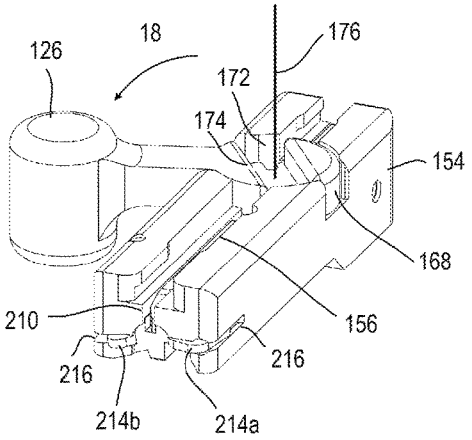
FIG. 16 is an enlarged isometric view of several components shown in FIG. 1.
Figure 17:
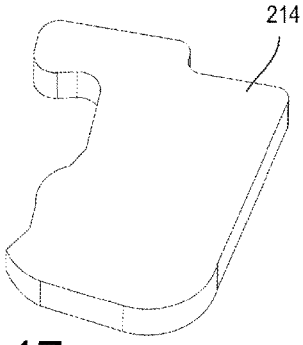
FIG. 17 is an enlarged isometric view of one of the components of FIG. 16 removed to show shape.
Figure 18:
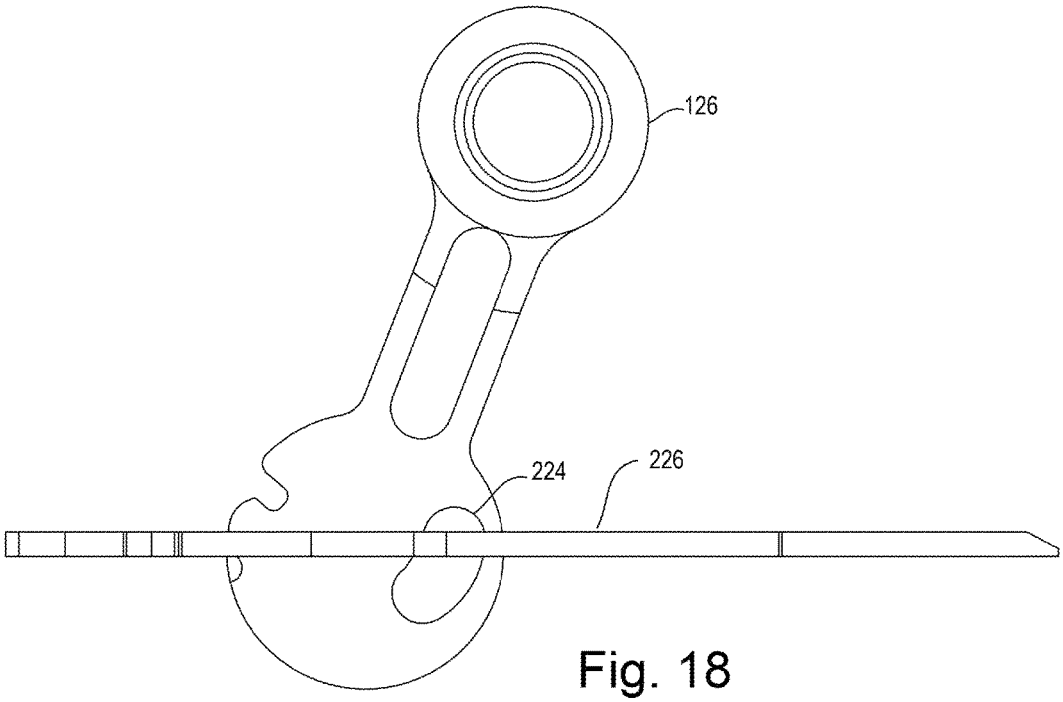
FIG. 18 is an enlarged top view of several components shown in FIG. 1.

Looking to FIG. 16, it can be seen that in this example the charge handle 126 has been rotated forward in rotational direction 18 about the rotational axis 176. In this position, as seen, the uninterrupted cut 174 is no longer aligned with the T-slot 156 and thus the bolt 154 and attached charge handle 126 is not permitted to slide along the I-beam rail 148.

In one example the I-beam rail 148 is attached to the receiver 120 via fasteners 140. In other examples it is attached by other methods. In this rotational orientation, neither the charge handle 126 nor bolt 154 is permitted to reposition (linearly) relative to the receiver 120. In this firing position, actuation of the trigger as disclosed above will fire a cartridge and will not result in movement of the bolt 154.

Figure 3:
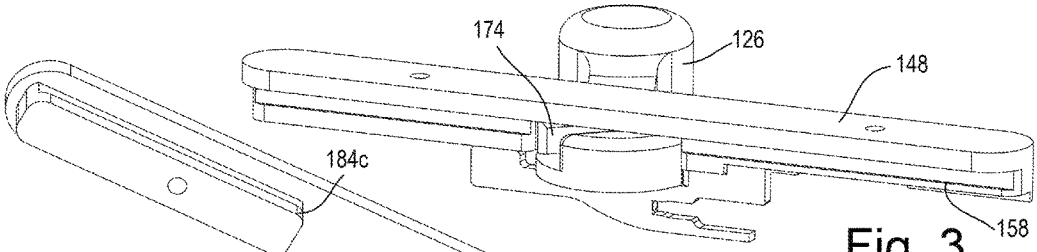
FIG. 3 is an enlarged isometric view of several components shown in FIG. 1.
Figure 4:
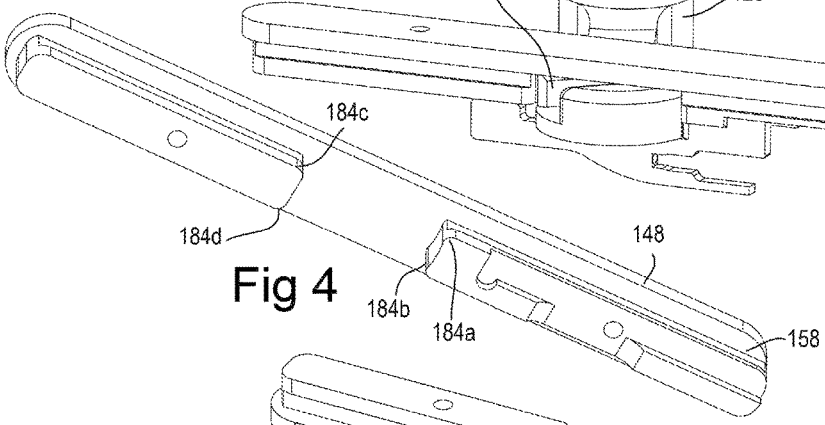
FIG. 4 is another enlarged isometric view of several components shown in FIG. 1 shown from a different angle.
Figure 5:
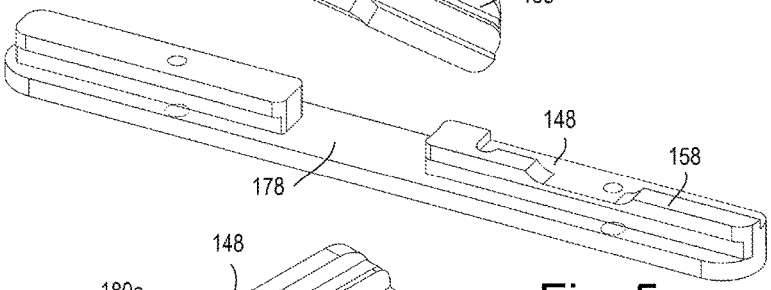
FIG. 5 is another enlarged isometric view of several components shown in FIG. 1 shown from a different angle.
Figure 6:
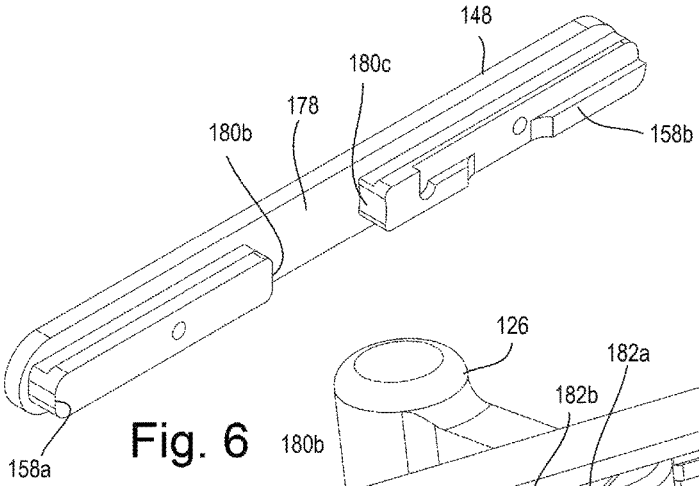
FIG. 6 is another enlarged isometric view of several components shown in FIG. 1 shown from a different angle.
Figure 7:
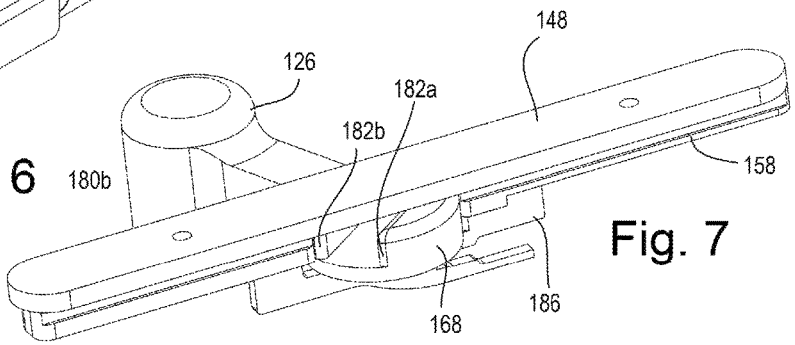
FIG. 7 is another enlarged isometric view of several components shown in FIG. 1 shown from a different angle.

FIG. 3 shows the relative position of the charge handle 126 relative to the I-beam rail 148 wherein the uninterrupted cut 174 is no longer aligned with the T-shaped protrusion 158. Looking to FIGS. 4-6 and 8 it can be seen that the T-shaped protrusion 158 is shown as a longitudinally forward component **158*a* and a longitudinally rearward component 158*b* with a cutout region 178 therebetween. The cutout region 178 in this example having small concave cylindrical surfaces 180 which engage the convex cylindrical surface 168 of the charge handle 126 as shown in FIG. 7 as the charge handle 126 enters the cutout region 178. In addition, rounded edges 182** (*a-c*) on the charge handle 126 along with rounded edges 184 on the T-shaped protrusion 158 adjacent the cutout region 178 align the cylindrical surface 168 with the cylindrical surface 180 when rotation of the charge handle 126 is desired.

When the charge handle 126 is repositioned longitudinally forward and rotated in the direction of travel 18 to the position shown in FIG. 16, the uninterrupted cut 174 is not aligned with the T-slot 156 and thus, the cylindrical convex outer surface of the charge channel 126 provides a locking lug of the action when the cartridge to be fired is "in battery" ready to be fired.

To prohibit the charge handle 126 from rotating and binding against the bolt guide rail 148 while the action is being cycled, a timing lock 186 is utilized. Such a timing lock 186 as shown for example in FIG. 7. In FIG. 11 for example the timing lock 186 has a forward end 188 with an upper surface 190 which rests upon the lower surface 192 of the bolt guide rail. The timing lock 186 also has a rearward end 194 with an upper surface 196 which contacts and engages a notch 198 in a protrusion 200 extending downward from the lower surface 202 of the T-shaped protrusion 158. A compression spring 204 is engaged within a notch 206 in the timing lock 186 to provide pressure in a forward longitudinal direction 12 and to engage and be received by a surface defining a notch 208 in the charge handle 126. When thus engaged, as the timing lock 186 rides in a surface defining a channel 210 of the bolt 154 as most easily seen in FIG. 16, the charge channel 126 is prohibited from rotating. As the charge handle reaches the forward end of its stroke, and the cartridge is in battery, the forward end 188 of the timing lock 186 contacts the forward end 212 (see FIG. 2) of the bolt 154. Contact between these two components forces the timing lock 186 rearward, thus disengaging the timing lock 186 from the notch 208 and forward pressure continued against the charge channel 126 will rotate the charge handle 126 in direction 18 so as to block the bolt 154 in position.

The timing lock 186 also serves as a detent when the charge handle 126 is rotated into battery. This function keeps the charge handle 126 from rotating out of battery when the firearm is fired or being transported.

The week side extractor(s) 214 (*a-b*) rests within a slot 216 and stabilizes the spent cartridge as it is removed from the chamber 162 and is held against the bolt 154 as the bolt 154 is moved rearward to eject the spent cartridge and load a new cartridge. The new feature of this embodiment involves there being no need for a notch in the barrel in that the weak side extractor retracts into the bolt when the action is closed. This functionality makes it possible for use of a factory Ruger 10/22 barrel.

The headspace bushing 134 as previously described is threaded into the receiver where the barrel 22 seats and compresses a spacer 136 which may be a rubber oh rain providing uniform tension to the shoulder 218. This spacer 136 and headspace bushing 134 allows for final adjustment of the head space and accounts for tolerance stack up in all mating parts. The action is completely assembled and the headspace bushing 134 is then threaded to a preset depth giving the final assembly an exact set from the barrel shoulder surface 220 as determined from the shoulder surface 218 to the bolt face.

Figure 8:
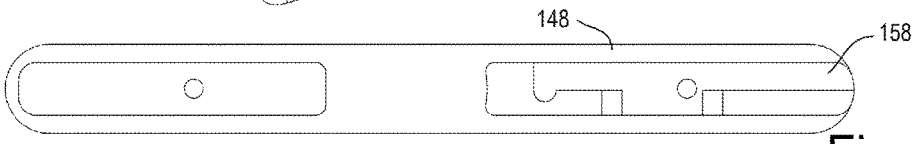
FIG. 8 is another enlarged bottom view of several components shown in FIG. 1.
Figure 19:
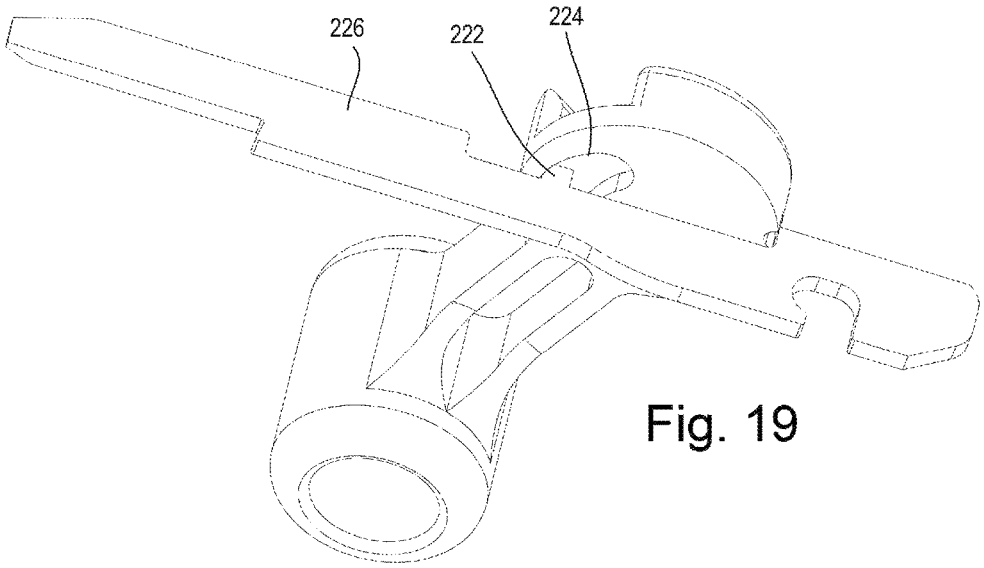
FIG. 19 is an enlarged isometric view of several components shown in FIG. 19.

Also shown in FIGS. 16, 8, and 19 is a firing pin 226 which has a tab 222 which protrudes vertically upwards into an oval slot 224 in the charge handle 126. This arrangement makes it impossible for the rifle to fire out of battery. When the charge handle 126 is rotated out of battery, the tab 222 holds the firing pin 226 free from any interaction with the breach face. The firing pin 226 slides longitudinally in the slot 210 adjacent the timing lock 186.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

The invention claimed is:

1. A firing mechanism comprising:

a receiver having a cavity therein configured to accept a bolt;

the firing mechanism comprising a bolt guide rail on an inner surface of the cavity of the receiver;

the firing mechanism also comprising a bolt, sliding along a first axis of the bolt guide rail;

a charge handle attached to the bolt so as to rotate relative thereto about a second axis orthogonal to the first axis;

the charge handle connected to the bolt so as to linearly reposition therewith;

the charge handle having a surface defining a cut therein aligned with a slot in the bolt when the bolt is in a rearward position; and wherein the surface defining the cut in the charge handle is not aligned with the slot in the bolt when the bolt is in a forward position.

2. The firing mechanism as recited in claim 1 further comprising a timing lock arm configured to engage a surface defining a slot in the charge handle so as to prohibit rotation of the charge handle when the bolt is not in a forward position.

3. The firing mechanism as recited in claim 1 further comprising a surface defining a t-slot in the bolt engaging a T-shaped protrusion mounted to the receiver so as to restrict movement of the bolt relative to the receiver.

4. The firing mechanism as recited in claim 3 wherein the T-shaped protrusion comprises an I-beam rail removably attached to the receiver.

5. The firing mechanism as recited in claim 1 further comprising a firing pin movably attached to the charge handle so as to reposition within the receiver when the bolt is not in a most forward position.

6. The firing mechanism as recited in claim 1 wherein:

the charge handle comprises a convex cylindrical surface having an axis parallel to the axis; and the bolt has concave cylindrical surface engaging the convex cylindrical surface of the charge handle allowing rotational movement of the charge handle relative to the bolt.

* * * * *